US006709343B1

(12) United States Patent
O'Connor et al.

(10) Patent No.: US 6,709,343 B1
(45) Date of Patent: Mar. 23, 2004

(54) GOLF PUTT TRAINING APPARATUS

(75) Inventors: William T. O'Connor, Birmingham, MI (US); Paul E. Reehil, Bloomfield Hills, MI (US)

(73) Assignee: Mystic Golf, L.L.C., Bloomfield Hills, MI (US)

( * ) Notice: Subject to any disclaimer, the term of this patent is extended or adjusted under 35 U.S.C. 154(b) by 0 days.

(21) Appl. No.: 10/241,293

(22) Filed: Sep. 11, 2002

(51) Int. Cl.[7] ..... A63B 53/16

(52) U.S. Cl. ..... 473/265; 473/219; 473/257; 473/256; 473/260; 473/261; 473/262

(58) Field of Search ..... 473/265, 219, 473/257, 258, 260, 261, 262, 263, 264, 279, 157

(56) References Cited

U.S. PATENT DOCUMENTS

| | | | | | |
|---|---|---|---|---|---|
| 2,712,939 | A | * | 7/1955 | Harp | 473/265 |
| 2,894,755 | A | * | 7/1959 | Scelzo, Jr. | 473/265 |
| 3,009,704 | A | * | 11/1961 | Heard | 473/151 |
| 3,166,326 | A | * | 1/1965 | Mundy, III | 473/265 |
| 3,194,565 | A | * | 7/1965 | Schroer | 473/265 |
| 3,246,898 | A | * | 4/1966 | Shoaf, Jr. | 473/265 |
| 3,332,688 | A | * | 7/1967 | Gevertz | 473/265 |
| 3,471,155 | A | * | 10/1969 | Donaldson | 473/260 |
| 3,572,720 | A | | 3/1971 | Berg | |
| 3,685,833 | A | * | 8/1972 | Jack, Jr. | 473/151 |
| 3,741,550 | A | | 6/1973 | Landures | |
| 4,437,669 | A | * | 3/1984 | Pelz | 473/265 |
| 4,465,281 | A | | 8/1984 | Whitfield | |
| 4,526,373 | A | * | 7/1985 | Medlock | 473/265 |
| 4,826,174 | A | | 5/1989 | Hoyt, Jr. | |
| 4,913,440 | A | | 4/1990 | Ellington | |
| 5,282,627 | A | * | 2/1994 | Beck | 473/260 |
| 5,292,130 | A | * | 3/1994 | Hooper | 473/279 |
| 5,320,355 | A | * | 6/1994 | Johnson | 473/265 |
| 5,435,547 | A | * | 7/1995 | Lee | 473/225 |
| 5,785,604 | A | * | 7/1998 | Johnson | 473/265 |
| 5,797,804 | A | | 8/1998 | Chen | |
| 5,961,393 | A | | 10/1999 | Heller et al. | |
| 6,019,685 | A | * | 2/2000 | Fonseca et al. | 473/265 |
| 6,159,106 | A | * | 12/2000 | Adams | 473/265 |
| 6,443,852 | B1 | * | 9/2002 | Kim | 473/265 |

* cited by examiner

*Primary Examiner*—Paul T. Sewell
*Assistant Examiner*—Nini F. Legesse
(74) *Attorney, Agent, or Firm*—Harness, Dickey & Pierce, P.L.C.

(57) ABSTRACT

A golf putt training apparatus is provided which assists a golfer in maintaining the putter head along an intendded target line while practicing a putting stroke. The training apparatus includes a pair of mutually opposing guide rails having plurality of substantially rigid teeth projecting in the direction of the opposing guide rail which stop the putter head from advancing off the intended target line. By leaving to advance the putter head between the guide rails without engaging the rigid teeth a golfer can develop a habit of keeping the putter head on the desired target line during a putting stroke.

18 Claims, 3 Drawing Sheets

GOLF PUTT TRAINING APPARATUS

FIELD OF THE INVENTION

The present invention relates to a training apparatus for use by a golfer to practice a putting stroke and, in particular, an apparatus which provides the golfer with immediate feedback in the event that their putting stroke is off the target line.

BACKGROUND OF THE INVENTION

As has been recognized by golfers for many years, one of the main aspects of a good golf game is what is commonly referred to as a strong short game. In particular, a sound putting game upon reaching the target green is of paramount importance. Essentially, there are two key aspects to developing a sound putting game as part of a round of golf namely, the ability to effectively judge how hard to strike the golf ball and the ability to identify and strike the ball along the intended target line. Often times, golfers have significant difficulty in maintaining the putter head along the intended target line, thus, causing the ball to be misdirected resulting in an ineffective putt. Absent the use of a golf putt training aid, it is extremely difficult for a golfer, particularly a novice or high handicapper, to identify the point at which the putter head departed from the intended target line.

Numerous golf putt training aids have been proposed to assist golfers in practicing their putting stroke and particularly for helping a golfer maintain the putter head along an intended target line. While many golf putt training aids assist in teaching a golfer how to strike the ball along an intended target line, very few assist the golfer in identifying the point at which the putter head departed from the preferred target line.

One golf putt training aid which appears to have been intended to at least provide a golfer with some feedback as to when the putter head departs the intended target line is demonstrated in U.S. Pat. No. 3,572,720 by Edward T. Berg. According to this patent, the apparatus comprises a generally U-shaped channel including sidewalls having a plurality of spaced apart flexible flaps projecting towards each other. When a golfer attempts to putt a golf ball within the channel, the putter head must stay free of the opposed flaps on either side of the U-shaped channel to accomplish an effective stroke. If the putter head engages one or more of the flexible flaps, the golfer is able to sense that the putting stroke is off the intended target line.

While the above described golf putt training aid may be helpful in learning to stroke a putt along an intended target line, because the flaps are flexible, the putter head would tend to advance through at least two or three flaps if the putter head is sufficiently off line. While the golfer would recognize that the putter head is off line, it is difficult for the golfer to tell exactly where the putter head went off line. Thus, there is a need for a golf putt training apparatus which provides the golfer with instantaneous feedback when the putter goes off the intended target line during a putting, stroke. There is also a need for a golf putt training aid which can be adjusted to accommodate different putter heads. Further, there is a need for a golf putt training apparatus which is easily transported and can be used both indoors and outdoors.

SUMMARY OF THE INVENTION

A training apparatus for use by a golfer to practice a putting stroke along a target line is provided which comprises a pair of mutually opposing elongated guide rails which are spaced apart at least the length of a putter head. The guide rails include a substantially hollow body including base, a plurality of sidewalls extending from said base and a top wall traversing the sidewalls. Projecting from a side wall in the direction of said opposing guide rail are a plurality of longitudinally spaced substantially rigid teeth whereby upon advancing a putter head between said guide rails the putter head is stopped by the teeth if the putting stroke is sufficiently off the target line.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
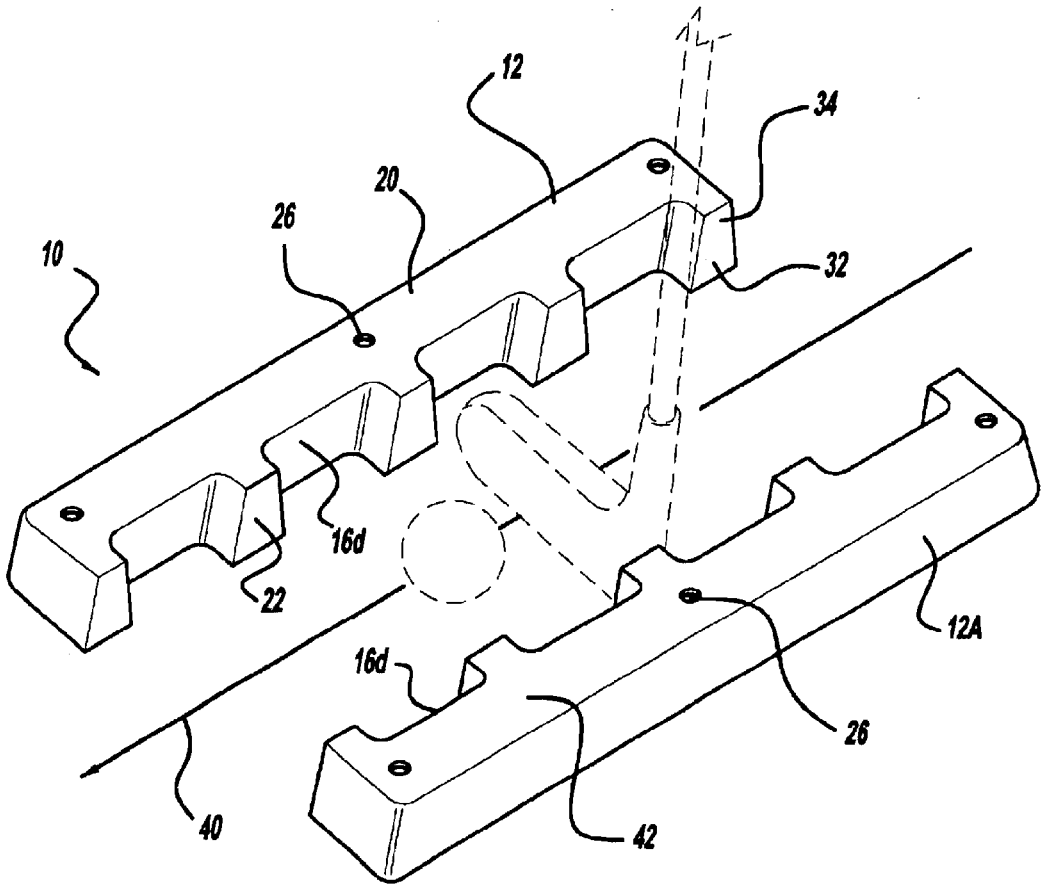
FIG. 1 is a perspective view of the golf putt training apparatus of the present invention.

Referring to FIG. 1, there is shown in the perspective view a golf putt training apparatus 10 in accordance with the teachings of the present invention. As previously noted, the training apparatus is designed to assist a golfer in developing the habit of maintaining the putter head along an intended golf putt stroke target line. Further, the golf putt training apparatus also provides a golfer with immediate feedback when the putter head departs from the intended target line by engaging one of a plurality of spaced apart teeth provided along one of the guide rails.

As demonstrated with particular reference to FIGS. 3–7, the golf putt training apparatus to include a pair of mutually opposing elongated guide rails 12, 12A which should be spaced apart at least the length of the putter head during use as illustrated by FIG. 1.

Figure 4:
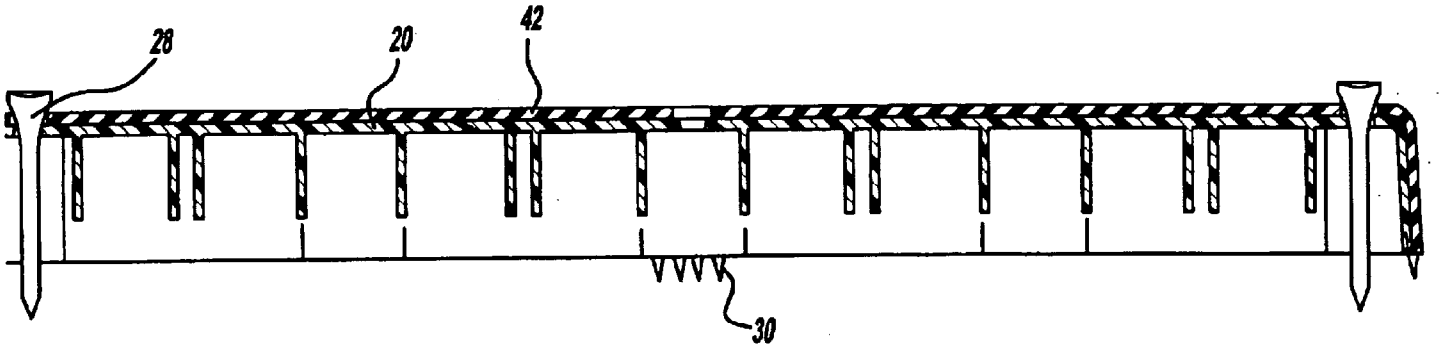
FIG. 4 is a sectional view taken along line 4—4 of FIG. 3.

Each guide rail 12, 12A includes a substantially hollow body 14 typically formed from injection molded plastic to include a plurality of side walls 16*a*–16*d* which extend from the base 18. Traversing the side walls is a top wall 20 generally parallel to the substrate (not shown) upon which the apparatus is positioned for use. Preferably, the top wall of each guide rail includes a plurality of spaced apart apertures 26 for receiving an anchoring fastener 28 as shown in FIG. 4. While the anchoring fasteners can be of many forms, conveniently the apertures are sized for receiving a golf tee which can be used as the anchoring fastener. Alternatively, or in addition to the anchoring fasteners 28, studs 30 can be provided along the base of each guide rail to assist in securing the guide rail to the desired substrate. Thus, it is envisioned that the studs can penetrate a carpeted surface, for example, in the event that the golf putt training apparatus is being utilized indoors.

Figure 2:
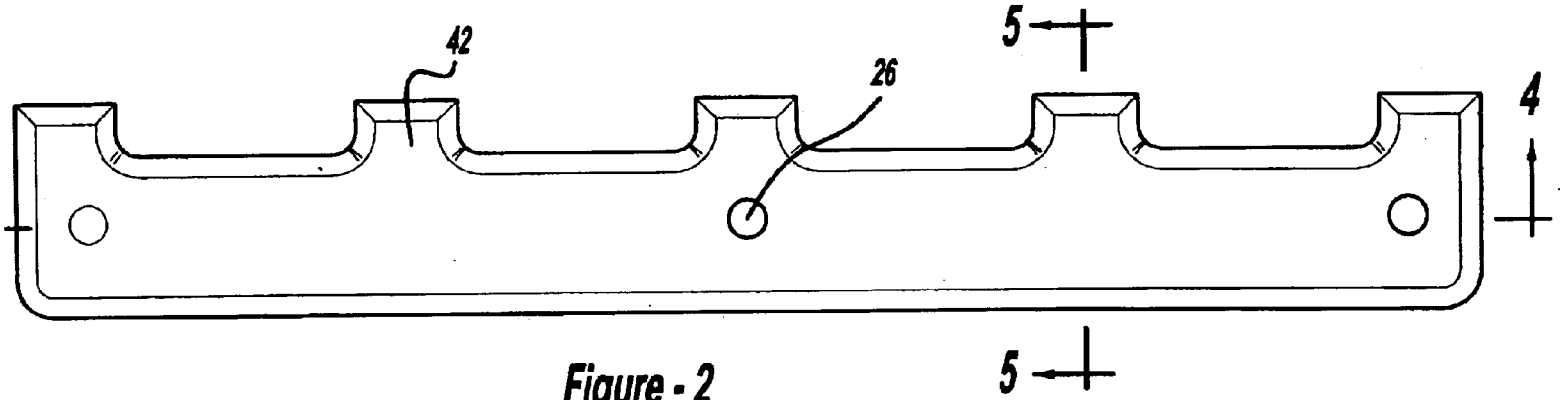
FIG. 2 is a top view demonstrating a golf putter head in phantom going off the intended target line and engaging the apparatus.
Figure 3:
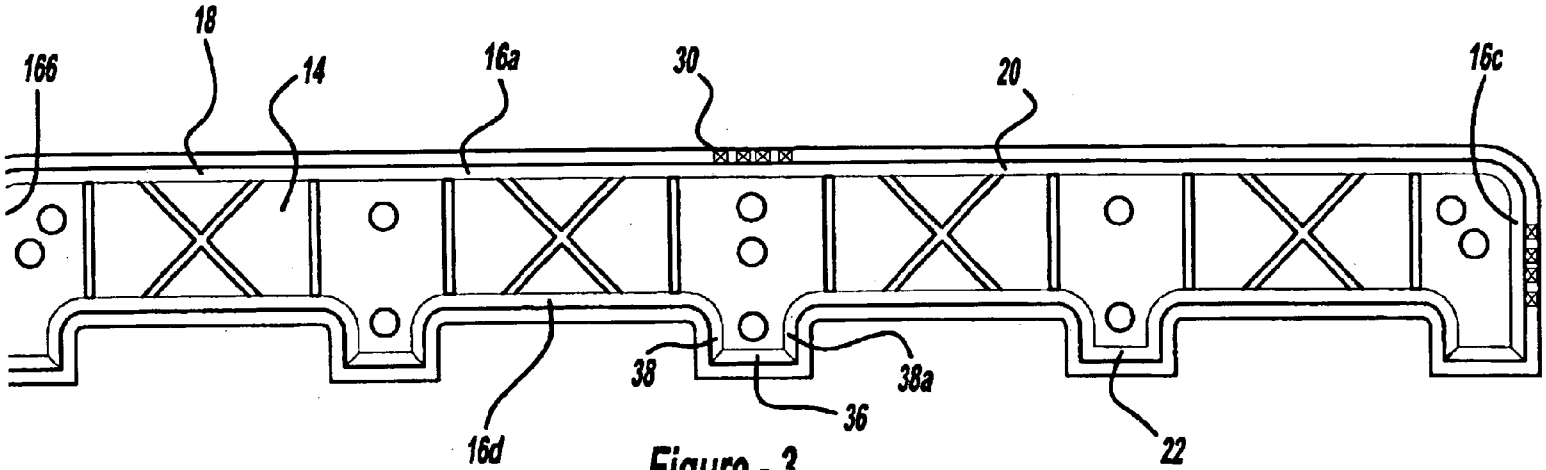
FIG. 3 is a bottom view of one of two guide rails which comprise the apparatus.

A key aspect to the present invention is the plurality of longitudinally spaced substantially rigid teeth 22 provided along side wall 16*d* of each of the guide rails. By providing such teeth along one of the longitudinal side walls of each of the guide rails, the teeth can be positioned such that they project in the direction of the opposing guide rail as illustrated in FIGS. 1 and 2. The teeth 22 are generally equidistantly spaced apart from between about 1.0 to 3.0 inches along the side wall 16*d*. If the space between adjacent teeth is smaller than about 1.0 inch, the putter head may not sufficiently engage a tooth 22 and may continue to advance beyond the point of initial contact. Additionally, if the teeth are spaced more than about 3.0 inches between successive teeth, the putter head may be well enough off the target line prior to contacting a tooth then meaningful feedback is not provided. Preferably, the teeth 22 are trapezoidal in shape with a wider base portion 32 and a narrower top portion 34. For ease in molding, it is also preferred that the face 36 be angled rearwardly from the base to the top which assists evacuation of the part from a mold.

The teeth 22 are also designed to include walls 38, 38*a* extending between the sidewall 16*d* and face 36. As shown in FIG. 2, the putter head, shown in phantom, engages a wall 38 or 38*a* when the putter head is advanced sufficiently off the target line 40. The height of the teeth should be at least about 1.0 inch and preferably about 1.5 inches to accommodate different sized putter heads.

Figure 6:
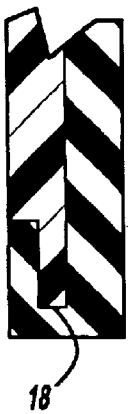
FIG. 6 is an enhanced view of a section 6 of FIG. 5.
Figure 7:
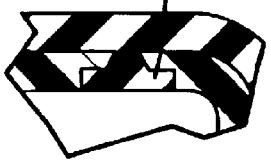
FIG. 7 is an enhanced view of a section 7 of FIG. 5.
Figure 5:
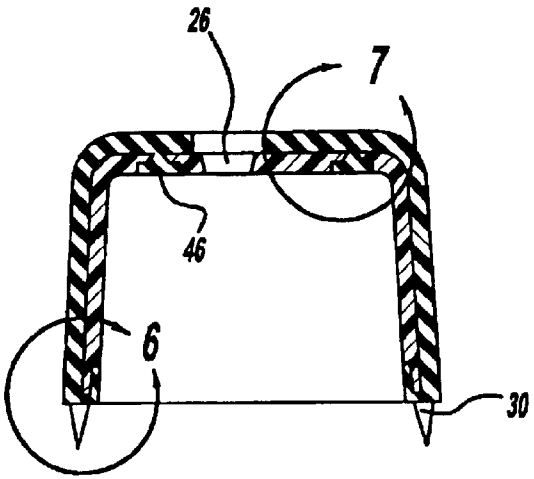
FIG. 5 is a sectional view taken along line 5—5 of FIG. 3.

Preferably, the plastic body of the guide rails 12, 12A are provided with an overmolded elastomeric covering 42 which along the sidewalls 16*a–d* and top wall 20. For enhanced adherence, the covering should envelop the base 18 as shown in FIGS. 5–7 and fill cavities 46 provided along the guide rails 12, 12A. The elastomeric cover, which preferably is an EPDM material, should have a thickness of at least 1.5 mils to provide a certain amount of damping as the putter engaged one of the teeth. A commercially available elextomer known as SANTOPRENE® is considered to provide this damping characteristic.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A training apparatus for use by a golfer to practice a putting stroke along a target line comprising a pair of mutually opposing molded elongated guide rails which are adjustably spaced apart from each other at least the length of a putter head, said guide rails including a substantially hollow body including a base, a plurality of sidewalls extending from said base and a top wall traversing said sidewalls, said body having a plurality of longitudinally spaced substantially rigid teeth projecting from a sidewall in the direction of said opposing guide rail, such that upon advancing a putter head between said guide rails the putter head is stopped by said teeth if the putting stroke is sufficiently off the target line.

2. The training apparatus of claim 1 wherein said body is formed of plastic.

3. The training apparatus of claim 2 wherein said plurality of teeth are equidistantly spaced.

4. The training apparatus of claim 3 wherein said plurality of teeth are spaced apart along the same guide rail in the range of between about 1.0 inches to about 3.0 inches.

5. The training apparatus of claim 4 wherein said teeth are substantially trapezoidal in shape.

6. The training apparatus of claim 1 wherein said body includes a plurality of apertures through which anchoring fasteners are inserted to secure said apparatus to a substrate.

7. The apparatus of claim 6 wherein said anchoring fasteners are golf tees.

8. The apparatus of claim 1 further comprising an overmolded elastomeric cover.

9. The apparatus of claim 8 wherein said overmolded elastomeric cover has an average thickness of at least 1.5 mils.

10. A training apparatus for use by a golfer to practice a putting stroke along a target line comprising a pair of mutually opposing elongated guide rails which are adjustably spaced apart from each other at least the length of a putter head, said guide rails including a substantially hollow body and an overmolded elastomeric cover, said body including base, a plurality of sidewalls extending from said base and a top wall traversing said sidewalls, said body having a plurality of longitudinally spaced substantially rigid trapezoidal shaped teeth projecting in the direction of said opposing guide rail, such that upon advancing a putter head between said guide rails the putter head is stopped by said teeth if the putting stroke is sufficiently off the target line.

11. The training apparatus of claim 10 wherein said elastomeric cover generally overlays said sidewalls and top wall and is secured to said body by overlapping the edge of said base.

12. The training apparatus of claim 11 wherein said overmolded elastomeric cover is further secured to said body by extending through openings along said body.

13. The training apparatus of claim 10 wherein said body is formed of plastic.

14. The training apparatus of claim 13 wherein said plurality of teeth are equidistantly spaced.

15. The training apparatus of claim 14 wherein said plurality of teeth are spaced apart along the same guide rail in the range of between about 1.0 inches to about 3.0 inches.

16. The training apparatus of claim 10 wherein said body includes a plurality of apertures through which anchoring fasteners are inserted to secure said apparatus to a substrate.

17. The apparatus of claim 16 wherein said anchoring fasteners are golf tees.

18. The apparatus of claim 10 wherein said overmolded elastomeric cover has an average thickness of at least 1.5 mils.

* * * * *